United States Patent [19]

Raheb

[11] 4,084,081

[45] Apr. 11, 1978

[54] PORTABLE SURVEY SYSTEM

[76] Inventor: William J. Raheb, 96 Sherman St., Brooklyn, N.Y. 11218

[21] Appl. No.: 697,718

[22] Filed: Jun. 21, 1976

[51] Int. Cl.[2] ..... G07C 13/00

[52] U.S. Cl. ..... 235/52; 179/2 AS

[58] Field of Search ..... 235/52, 54 F; 179/2 AS; 340/332

[56] References Cited

U.S. PATENT DOCUMENTS

| | | | |
|---|---|---|---|
| 2,439,041 | 4/1948 | Crabtree | 235/52 |
| 3,190,014 | 6/1965 | Rhodes | 235/52 |
| 3,281,823 | 10/1966 | Foresman, Jr. | 235/52 |

*Primary Examiner*—Stephen J. Tomsky

*Attorney, Agent, or Firm*—Wender, Murase & White

[57] ABSTRACT

A portable survey system housed in a suitcase-like assembly, the cover of which supports an electronic display panel having a number of individually energizable display elements. A number of responder units, each connected with the display assembly to control the selective energization of a group of display elements, enables various individuals to cast votes which are preserved in total anonymity by the "pseudo-random" energization of the display and the use of a master control switch to prevent any display from being provided until after all votes are cast. The base of the case contains a plurality of separate compartments for receiving the individual responders for storage whereby the entire unit is self-contained and may be easily transported and subsequently set up for use in businesses, schools, hospitals, or merely for entertainment purposes.

12 Claims, 4 Drawing Figures

PORTABLE SURVEY SYSTEM

BACKGROUND OF THE INVENTION

1. Field of the Invention

The present invention relates generally to voting equipment, and more particularly, to a portable survey system which is self-contained, is economical to construct and operate, and preserves voter anonymity in use.

2. Description of the Prior Art

Many businesses, schools, and other institutions have found it necessary or desirable to conduct surveys or polls in the course of their activities. The results of these polls may be used for any number of different purposes, and generally, the questions presented are straightforward and are neither controversial nor embarrassing. However, in many situations, the subject of opinion polls and surveys is extremely sensitive and may be considered by many of the polled individuals to be personal and private. In such circumstances, the polling institutions recognize the sensitivities of their audience and obtain prior consent. Unfortunately, however, many people give their consent not because they do not mind answering the questions, but because they don't want to be considered any different from other persons answering the poll. The granted consent is thus artificial, the individual thereafter preserving his or her privacy by giving only partially complete or truthful answers to the various questions.

As a result of situations typified by the above example, many surveys develop data which cannot be relied upon since the data base is only partially truthful. Obviously, there is no way of guaranteeing that any answers will be truthful, but it is well known that a much greater degree of accuracy can be expected when responses are maintained either totally secret or taken under conditions where total anonymity is preserved. Since a person answering a survey or poll can never be certain that his or her answers will be kept confidential or secret, the only sure way of maximizing survey results is to preserve total anonymity right from the initial survey.

In addition to the foregoing problems, it is often desired to poll or survey small audiences in environments which normally are not specifically reserved for voting or polling purposes. For example, a normal classroom environment may be the desired site for a survey during one or more particular classes. A conference room, meeting area, convention site, private office, etc. similarly are places where surveys are not normally taken, but where survey information may be desired from time to time. In these situations, it is both impractical and unnecessary to pre-wire switching devices into the room for the purpose of tallying answers to questions as they are being asked. Thus, a need has developed for a completely portable survey unit which can be set up in any number of different areas and used to take surveys with minimal disruption or preliminary arrangements.

The prior art is generally cognizant of voting and survey apparatus designed for various special purposes. U.S. Pat. No. 3,281,823, for example, is illustrative of an indicator system designed for use by legislatures to indicate the votes cast by different members on different legislative matters. Each voting member has a responding unit which activates the series of lights adjacent the member's name on a display board. After the members cast their votes, the display is activated and the total votes will be immediately known. While it appears that such systems have generally served their intended purpose, they are not totally satisfactory in that complete anonymity is not preserved and that the system is intended to be pre-wired permanently into an existing structure, and thus, is not portable.

A similar system for displaying the vote of various legislative bodies is shown in earlier U.S. Pat. No. 2,439,041. A system used not for legislatures but for teaching aid purposes, is shown in U.S. Pat. No. 3,190,014 which enables a teacher to poll his or her students during classroom instruction.

U.S. Pat. No. 3,319,254 is typical of many prior art systems used for taking audience reaction surveys. U.S. Pat. No. 3,766,541 is similar and allows the audience to indicate "degree of confidence" by manipulating potentiometers which individually control the display. Another audience response measuring system is illustrated in U.S. Pat. No. 3,766,453 which includes a recorder, a comparator, and an averaging network.

While the prior art, exemplified by the above-noted patents, is generally cognizant of many different types of voting and survey systems, none of these assemblies offers the convenience of self-contained portability for both the display panel and the responder units in a manner which allows quick and easy use, storage and transportation without unnecessary expense.

SUMMARY OF THE INVENTION

It is, therefore, an object of the present invention to house the display and responder assemblies of a portable survey system in a single, easily transportable case.

Another object of this invention is to facilitate the convenient storage of a number of responder units connected by relatively long lengths of cable to a display panel in a manner whereby both the responders and their associated cords are arranged and maintained in a orderly fashion free from potential damage.

In summary, the present invention is embodied in a portable survey system which includes a case having a base and a cover therefor, an electronic display assembly mounted in the cover, the display assembly having a plurality of individually energizable display elements, a plurality of responder units each connected with the display assembly to control the selective energization of a group of the display elements thereby to cast a vote, and a plurality of separate compartments in the base for receiving the plurality of responders, respectively, for storage, the responders being nested in the compartments with the cover closed onto the base for storage and transport of the system, and the responders being removed from the compartments with the cover disposed upright to expose the display for use of the system.

The present invention exhibits a number of advantages over the prior art in that the assembly is completely portable, that proper storage of responder units and connecting cables is facilitated, that substantial economy in manufacture is obtained, and that total anonymity of survey results is assured while at the same time substantially immediately displaying survey results.

Other objects and advantages of the present invention will become apparent from the following description of a preferred embodiment when taken in conjunction with the accompanying drawings.

DESCRIPTION OF THE PREFERRED EMBODIMENT

Figure 1:
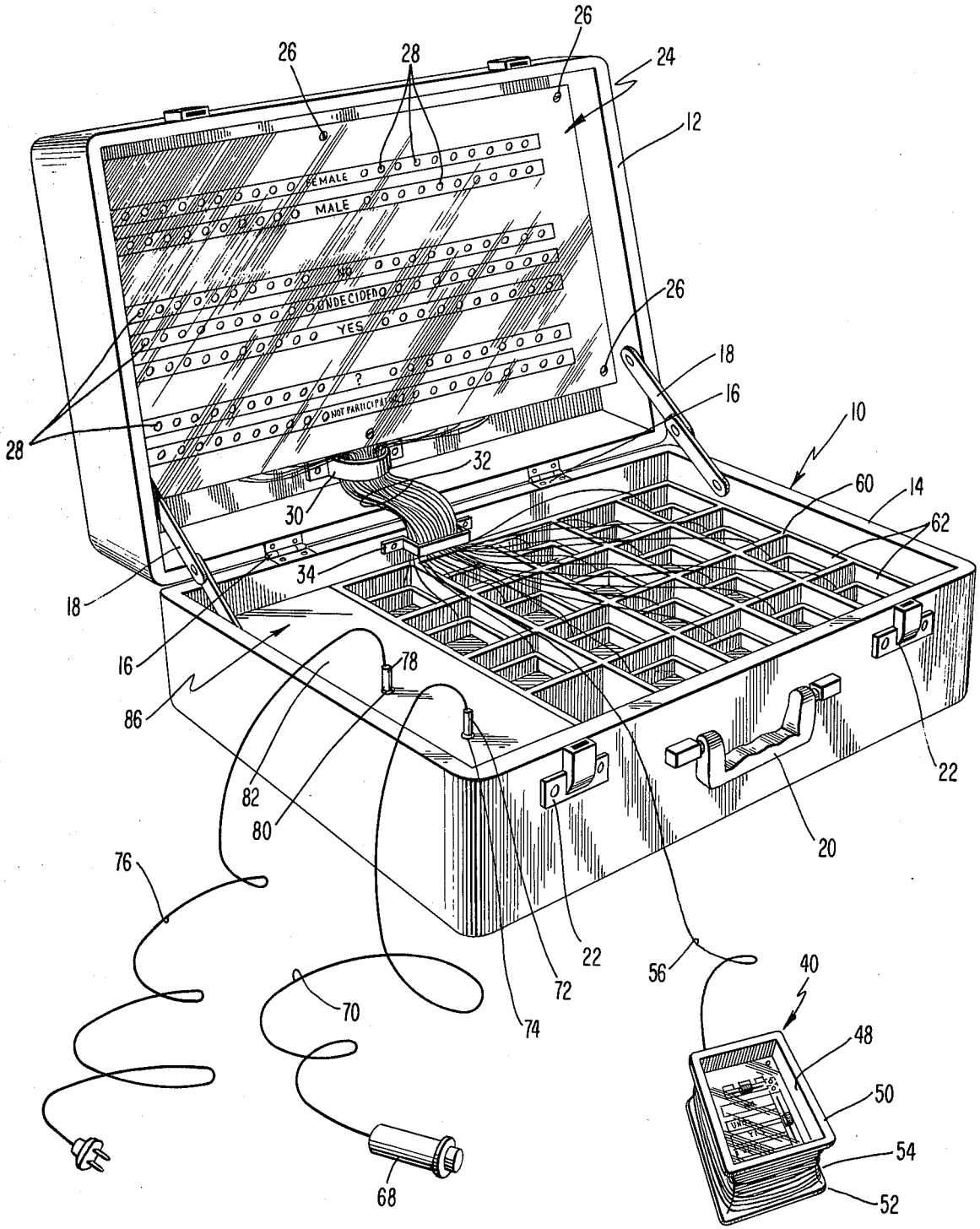
FIG. 1 is a prospective view of a preferred embodiment of a portable survey system according to the present invention.
Figure 2:
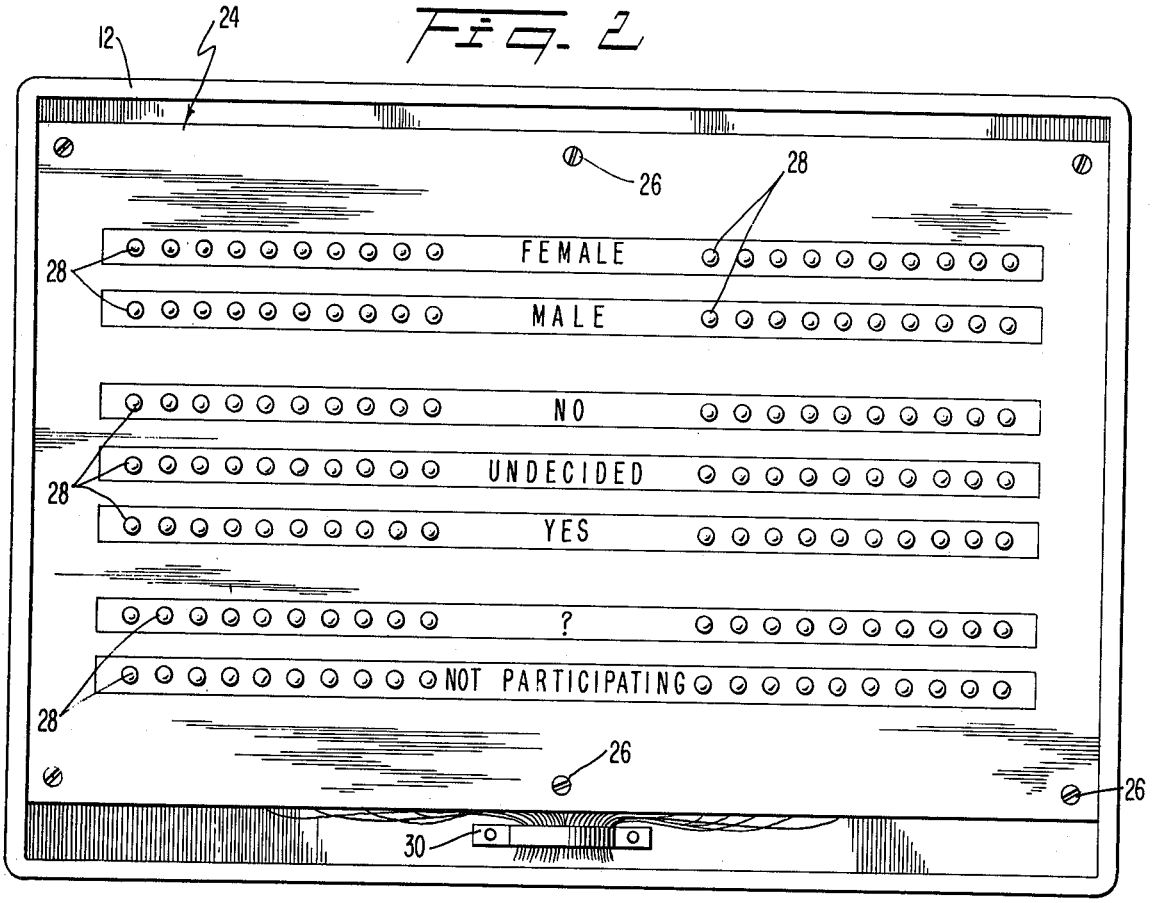
FIG. 2 is a front elevational view of the display assembly of the system of FIG. 1.
Figure 3:
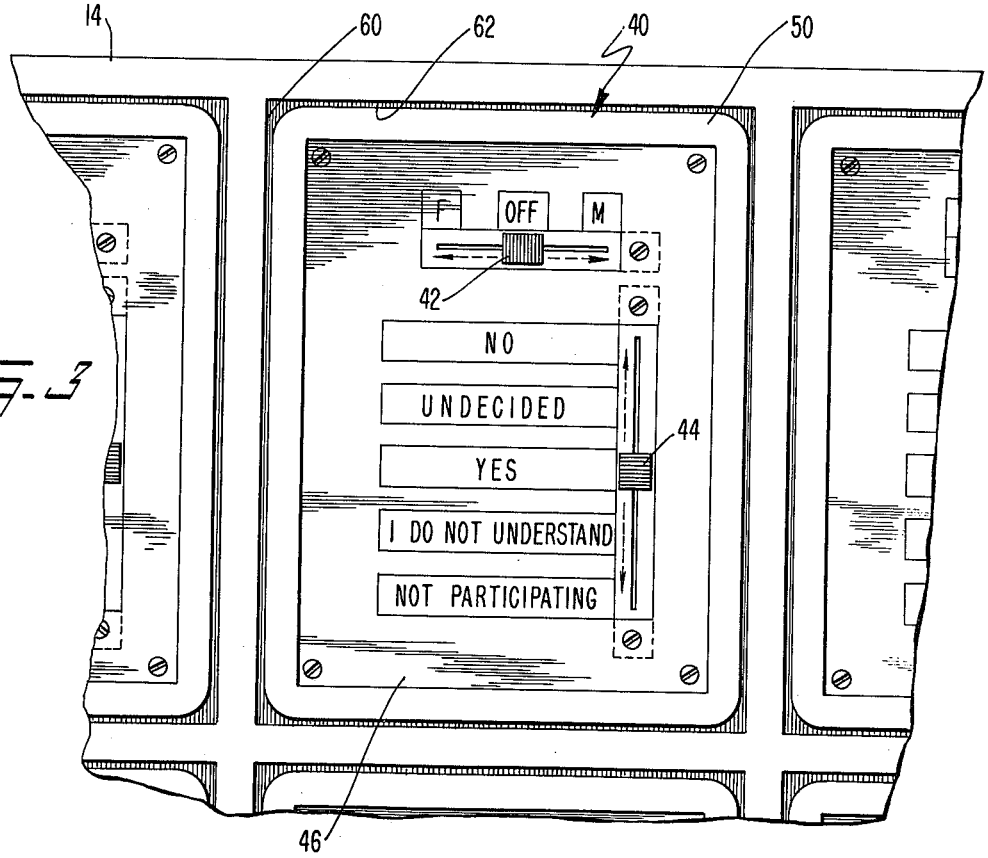
FIG. 3 is a top plan view of the compartmented base of the system of FIG. 1 showing a number of individual responder units in nested position.

Referring to FIGS. 1–3, the present invention is embodied in a suitcase-like case 10 having a cover 12 and a base portion 14. A pair of hinges 16 interconnects cover 12 with base 14, and a pair of folding arms 18 define the limit of upward travel of the cover and, preferably, are provided with appropriate detents (not shown) so as to hold the cover upright, as shown in FIG. 1. The base 14 is also provided with a suitable handle 20 as well as latches 22 to keep the cover closed during movement and storage of the system. While the case 10 may take any number of different configurations, it is preferred that the assembly generally contain the above-described elements for ease of use and transportation. The case may be made of any number of suitable materials such as wood, fiberboard, metal, and the like with suitable coverings of leather, artificial leather, cloth, etc. The case may also be painted or appropriately decorated, to suit individual needs or design specifications. In addition, and in the preferred mode, case 10 may be molded to any desired shape using synthetic plastic material. The entire case may be molded as one piece or cover 12 and base 14 may be made separate and joined by hinges, such as hinges 16. In both cases, however, the overall shape and appearance of the finished product may be aesthetically pleasing and, for instance, may be decorated so as to be coordinated with other business accessories such as attache cases and overnight luggage.

In addition to the foregoing, case 10 may be made of cardboard where, for example, the overall survey system is provided as a very economical home entertainment game. Cardboard or lightweight plastic material may be ideally suited for such applications of the present invention since extreme durability is not necessary for the type of use which can be expected.

A generally flat, rectangular display assembly 24 is fixedly attached to the interior of cover 12 by any suitable means such as screws 26. Display assembly 24 includes a number of incandescent lamps 28 arranged in columns and rows, as shown in FIGS. 1 and 2. Each of these lamps or display elements 28 provides a separate visual indication of survey response. Preferably, each row is surrounded by a differently colored border so that any lamp energized in that row indicates a vote for the designated answer. In the example illustrated in FIGS. 1 and 2, for instance, if 10 lamps in the first row were illuminated and 15 lamps were illuminated in the second row, the apparatus would indicate that the audience being surveyed consists of 10 females and 15 males. Of course, it should be appreciated that any particular row can be designated to indicate a particular answer providing that the system wiring corresponds to the answer designations on the individual responder units, to be described below.

Each column of lamps 28, which in the illustrated example consists of seven lamps, forms a separate indicator group associated with a particular responder. As will be more fully appreciated below, the present system preserves total anonymity of the various votes cast and, for this reason, it is imperative that the display panel 24 contain no markings or other labels associating any particular column with a particular responder unit. Individual wires from each lamp 28 are fed through a first generally U-shaped guide 30 to form a wire bundle 32. Bundle 32 is then directed through a second generally U-shaped guide 34 which also clamps the wires in place. The wire bundle 32 is sufficiently resilient to accommodate several openings and closings of cover 12 onto the base 14 without sustaining any damage.

The various wires in bundle 32 are connected to responder units 40 which contain a first three position slide switch 42 (FIG. 3) and a second five position slide switch 44. The switches 42 and 44 are mounted in the top wall 46 of a generally rectangular, hollow responder housing which is surrounded about its periphery by a rim 48 which extends above the plane of top wall 46. A pair of flanges 50 and 52 extend around the upper and lower borders of rim 48 and protrude outwardly so as to form a generally U-shaped channel 54 which extends completely around the responder 40. An individual cable 56 extending from the display assembly 24 to a particular responder 40 may be wrapped about the rim 48 within channel 54 and may be conveniently stored thereon when not in use.

Referring to FIGS. 1 and 3, the base 14 of case 10 includes a divider assembly 60 which divides the interior space in base 14 into a plurality of separate compartments 62. Each of these compartments is dimensioned to be slightly larger than the outer dimensions of the responder units 40 such that the responder units may be conveniently nested in individual compartments during storage. Since the inner dimensions of the compartments 62 are only slightly larger than the outer dimensions of the responders 40, the cable lengths wrapped about the rims thereof will be maintained in their proper position without unravelling or tangling during transportation and storage of the system. A master switch 68 is provided for use by the system operator to prevent the display of any vote information until after all of the votes have been cast. Switch 68 is connected by a line 70 and a plug and socket assembly 72–74 to the system circuit, as will be described below. Similarly, an AC cord 76 may be connected to the system by means of a plug and socket assembly 78–80. Preferably, sockets 74 and 80 are mounted in the top wall 82 of a separate housing 86 which, together with dividers 60, completely fill the interior of base 14, as shown. Housing 86 may contain a DC battery as well as additional circuit wiring, and also may provide space for spare parts and replacement equipment. A hinged cover or other suitable opening (not shown) may be provided in wall 82 or in base 14 for enabling easy access to the interior of housing 86.

Figure 4:
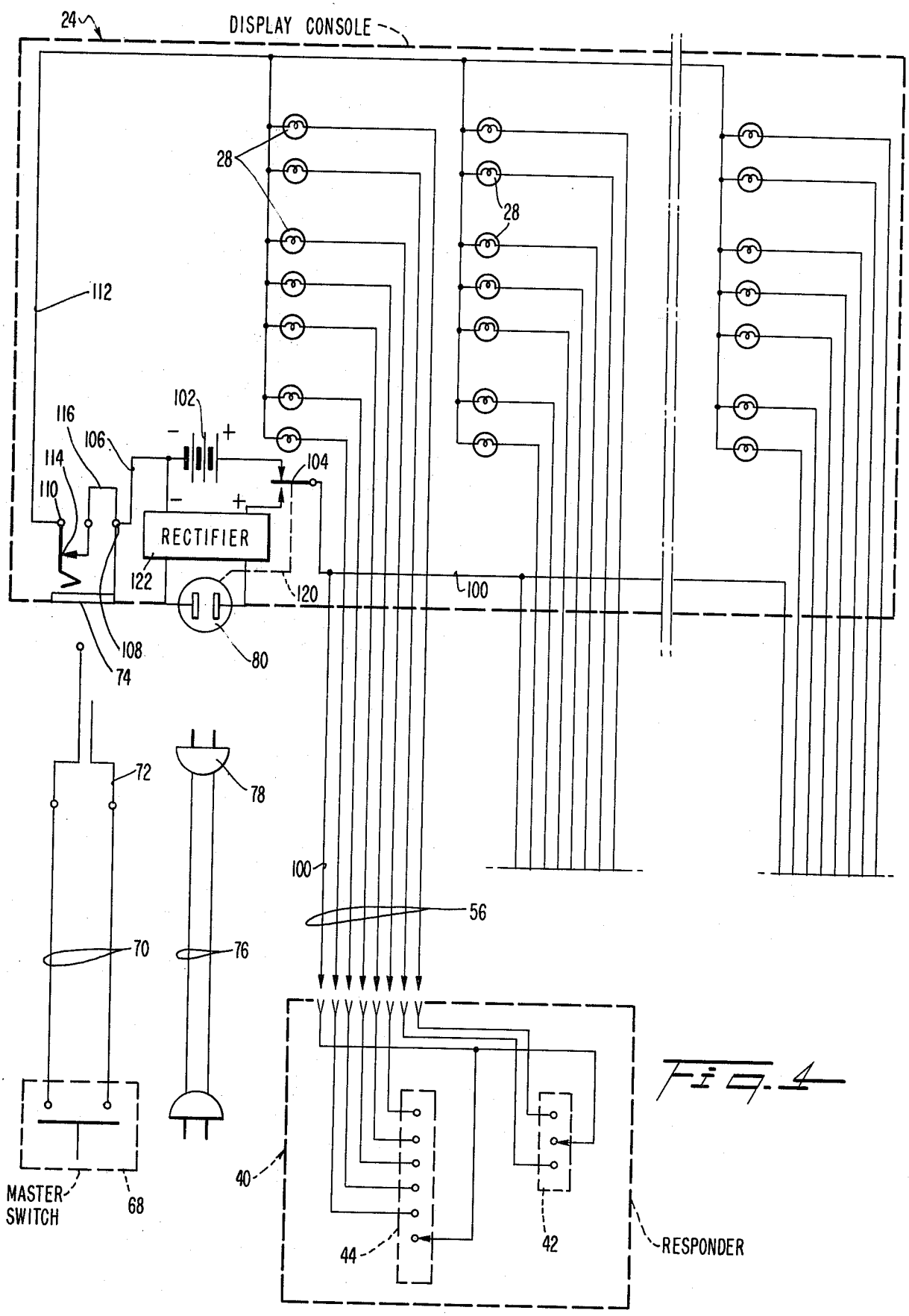
FIG. 4 is a schematic diagram of the electrical circuit of the system of FIG. 1.

Turning now to the schematic diagram of FIG. 4, the movable wiper arms of switches 42 and 44 are connected to each other and to a common wire 100 which is supplied with positive operating potential. During normal operation, the DC potential is supplied by a DC battery 102 which is connected through a single pole double throw switch 104 to line 100. Line 100 feeds positive potential to all of the responders in the system, as shown, and is considered as the positive bus. The negative terminal of battery 102 is fed via line 106 to a first terminal 108 of socket 74. The opposite terminal 110 of socket 74 is in turn connected over line 112 to one of the two terminals of each of the indicator lamps 28 in the system. Line 112 may be considered as the negative bus. Socket 74 preferably includes a set of normally closed contacts 114 connected by a jumper 116 to terminal 108. In this manner, whenever plug 72 is disconnected from the system, power will be supplied from terminal 108 over jumper 116 and contacts 114 to terminal 110. Negative bus 112 therefore will be connected to the negative terminal of battery 102. When plug 72 is inserted into socket 74, however, contacts 114 are opened and switch 68 is electrically interposed between terminals 108 and 110. Preferably, master switch 68 is a normally open switch so that the negative terminal of battery 102 will not be connected to negative bus 112 until the master switch is actuated.

Whenever it is desired to operate the system from an AC source of input potential, rather than battery 102, AC cord 76 can be added to the system by inserting plug 78 into socket 80. Insertion of plug 78 into the socket causes switch 104 to be moved from its reset position, shown in FIG. 4, to its actuated position by means of a mechanical link, illustrated diagrammatically by dashed line 120, between socket 80 and the movable arm of switch 104. Switch 104 thus disconnects battery 102 from the circuit and instead connects the DC output of a rectifier network 122. The input of rectifier 122 is connected across the terminals of socket 80 so as to receive the operating potential fed over lead 76.

Turning back to the responder 40, it is initially noted that only a single responder unit has been illustrated, solely for the sake of clarity and brevity. Furthermore, only three columns of indicator lamps 28 have been shown in the drawings, although it should be understood that any number of columns or groups of indicator elements may be provided to accommodate a like number of responder units connected in the system. For each column or designated group of indicator lamps 28, there will be associated a single responder 40. As noted above, one terminal of each indicator lamp 28 is connected in common to the negative bus 112. The opposite terminals of each indicator lamp are connected via suitable lines in cable 56 to respective fixed terminals of switches 42 and 44. In this manner, the switches 42 and 44 place various desired ones of the indicator elements across the positive and negative buses 100 and 112, respectively, thereby causing their illumination. Switch 42, for example, has a central "off" position between two extreme end positions causing the connection of either the first or the second lamp 28, counting from the top of the column associated with the particular responder, to be connected to the positive bus 100. Similarly, the upper five positions of switch 44 cause the respective connection of the next five lamps 28 in the column to positive bus 100. The extreme end position of switch 44 is a second "off" position which may be provided, if desired. By providing two switches 42 and 44, each responder unit may cause the illumination of two separate lamps in the column associated with that responder for each question asked in the survey. In effect, each of the lamps 28 is connected in series with a switching element to form a series network, and all of the series networks are connected in parallel between the source of potential, battery 102 or AC rectifier 122, and the master switch 68.

It should be understood, of course, that any number of switches may be provided in the responder and different types of switches other than slide switches may be used, if desired. In addition, the polarity of the positive and negative buses 100 and 112 may be reversed, and switch 104 may be coupled to socket 80 so that the system is normally designed to operate from AC current and is switched to battery power when the plug 78 is removed from socket 80.

For purposes of explanation, the display assembly shown in FIG. 2 has been provided with seven rows indicating, respectively, the number of females and males in the audience, and the number of no, undecided, yes, do not understand, and not participating answers. As can be appreciated from FIGS. 3 and 4, after each question is asked, individuals holding responder units may move slide switch 42 either to the left or to the right to indicate their sex. Switch 44 may also be moved to register their answer to the question which has been presented. During this time, all of the other persons in the audience being surveyed will likewise cast their votes. During this time, master switch 68 will have been open such that the negative terminal of battery 102 will be disconnected from negative bus 112. Thus, none of the indicator lamps will be illuminated and no one in the audience will known the results of the survey until all votes have been cast, and the master switch thereafter depressed. Actuation of the master switch completes the circuit and causes the various indicators which have been selected by the responders to be lit. The vote count then can be tallied and the next question can be asked. Since none of the individual responders are marked or otherwise identified as to the particular column of lamps to which it is attached, and since no indications are made until after all votes have been cast, complete anonymity will be preserved to encourage truthful responses without embarrassment. In addition, the design of the responder unit, with the upright rim 48, allows each answering individual to move the selector switches without his or her actions being seen by those persons seated around him.

As can be appreciated from the above, the present invention is extremely simple in design and construction, is economical to manufacture and maintain, and provides a portable survey system with complete anonymity and flexibility. The device may be set up in any area, classroom, office, or the like, by merely placing the base 14 on a desk or table, opening the cover 12 so as to present the display panel 24 in an upright position, and removing the necessary number of responders from their nested compartments. The operator who is conducting the survey controls the overall display and preserves anonymity by operating the master switch 68 so as to prevent the display of any votes until all responder units have been switched and the individual answers have been registered. Thereafter, actuation of the master switch causes the entire panel to become energized and the complete survey may be taken simply and effectively. Once the survey has been completed, the connecting cables 56 for each responder 40 are wrapped about the rim within the channel 54 and the responders are dropped into the different compartments. The case can then be covered thereby automatically securing the responders in their stored places with the cables prevented from fouling, tangling or becoming damaged.

It can be appreciated that the present invention may be made in any suitable size, shape or ultimate configuration, and it is contemplated that larger, more durable units may be made for business, educational or other purposes while at the same time smaller and more economical units may be made in the form of a game for home entertainment use. In the latter instance, a suitable pamphlet containing both operating instructions and suitable questions and rules for scoring may be provided with the questions designed specifically to elicit opinion on controversial or unusual questions. In view of the fact that the system operates with total anonymity, such a game may be played with friends and neighbors without fear of embarrassment or ridicule but with the assurance of entertainment and interesting discussion.

Inasmuch as the present invention is subject to many variations, modifications and changes in detail, it is intended that all matter contained in the foregoing description or shown in the accompanying drawings shall be interpreted as illustrative and not in a limiting sense.

What is claimed is:

1. A portable survey system, comprising:

a case having a base and a cover therefor;

an electronic display assembly fixedly mounted in said cover, said display assembly having a plurality of individually energizable display elements;

a plurality of responder units each coupled with said display assembly to control the selective energization of a group of said display elements thereby to cast a vote, each responder including a main body having a top wall, a plurality of switches on said top wall, and a peripheral rim extending completely around the periphery of said top wall and extending above and below the plane thereof to shield said switches from sight by other than the user of the responder; and a plurality of separate compartments in said base for receiving said plurality of responders, respectively, for storage, said responders being nested in said compartments with said cover closed onto said base for storage and transport of said system, and said responders being removed from said compartments with said cover disposed upright to expose said display for use of the system, said cover being connected to said base by a hinge and being movable between a first extreme position closed over said base and a second extreme position pivoted upright from said base and exposing said display.

2. The survey system as recited in claim 1 further including a master switch coupled to said display assembly to prevent the energization of said display elements by said responders until said master switch has been actuated whereby votes may be cast prior to display thereof to preserve anonymity.

3. The survey system as recited in claim 2 wherein each of said responders comprises a plurality of switches each connected in series with a different display element of the group associated with said responder to form series networks; and wherein all of said series networks are connected in parallel to form a parallel network, said parallel network being connected in series with a source of operating potential and said master switch.

4. The survey system as recited in claim 3 wherein said source of operating potential comprises a battery, a rectifier having a DC output and an input adapted to be connected to an AC power source, and a power switch having a first position connecting said battery to the system and a second position substituting said rectifier for said battery.

5. The survey system as recited in claim 4 further including a receptacle mounted on said case and connected to the input of said rectifier; and wherein said power switch normally assumes said first position and is connected to said receptacle for movement to said second position in response to insertion of a plug into said receptacle.

6. The survey system as recited in claim 3 wherein said master switch comprises a socket mounted on said case and connected in series with said source of operating potential and said parallel network, a normally-open switch, and a plug connected to said switch and cooperating with said socket to connect said switch in the system when said plug and said socket are inerconnected.

7. The survey system as recited in claim 6 wherein said socket includes plug responsive contacts coupled to short-circuit said socket when said plug is not connected thereto.

8. The survey system as recited in claim 1 wherein said display elements comprise lamps, said lamps being arranged in rows and columns; and wherein each of said groups of display elements comprises a respective column of lamps.

9. The survey system as recited in claim 1 wherein said rim is provided with outwardly extending flanges on the borders thereof whereby a length of cable interconnecting said responder and said display assembly may be wrapped around and stored on said rim, the outer dimensions of said flanged rim being substantially equal to the inner dimensions of said compartments such that said stored cable is prevented from inadvertent displacement from said nested responders during storage and transport of the system.

10. The survey system as recited in claim 3 wherein said plurality of switches for each of said responders comprise a first slide switch having first and second on positions separated by an off position, and a second slide switch having plural on positions and an off position at one end thereof.

11. A portable survey system, comprising:

an electronic display assembly having a plurality of individually energizable lamps arranged in rows and columns;

a plurality of responder units each connected with said display assembly to control the selective energization of a respective column of said lamps thereby to cast a vote;

a master switch coupled to said display assembly to prevent the energization of said lamps by said responders until said master switch has been actuated whereby votes may be cast prior to display thereof to preserve anonymity; and each of said responders including a plurality of independently operable switches each connected directly in series with a different lamp of the column associated with said responder to form series networks; and wherein all of said series networks are connected directly in parallel to form a parallel network, said parallel network being connected in series with a source of operating potential and said master switch.

12. The survey system as recited in claim 1 wherein each responder comprises a main body having a top wall, said plurality of switches being mounted on said top wall, and a peripheral rim extending completely around the periphery of said top wall and extending above and below the plane thereof whereby said switches are shielded from sight by other than the user of the responder.

* * * * *